US009550208B2

(12) United States Patent
Brouwer et al.

(10) Patent No.: US 9,550,208 B2
(45) Date of Patent: Jan. 24, 2017

(54) METHOD FOR SELECTIVELY PHOSPHATING A COMPOSITE METAL CONSTRUCTION

(71) Applicant: HENKEL AG & CO. KGaA, Duesseldorf (DE)

(72) Inventors: Jan-Willem Brouwer, Willich (DE); Frank-Oliver Pilarek, Cologne (DE); Matthias Hamacher, Huerth (DE); Marc Balzer, Monheim (DE); Roland Popp, Manching (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 539 days.

(21) Appl. No.: 13/718,342

(22) Filed: Dec. 18, 2012

(65) Prior Publication Data

US 2013/0202797 A1 Aug. 8, 2013

Related U.S. Application Data

(63) Continuation of application No. PCT/EP2011/060590, filed on Jun. 24, 2011.

(30) Foreign Application Priority Data

Jun. 30, 2010 (DE) ..... 10 2010 030 697

(51) Int. Cl.

| | |
|---|---|
| ***C23C 22/36*** | (2006.01) |
| ***B05D 3/10*** | (2006.01) |
| ***C23C 22/73*** | (2006.01) |
| ***C23C 22/83*** | (2006.01) |
| ***B05D 7/14*** | (2006.01) |

(52) U.S. Cl.

CPC ..... *B05D 3/107* (2013.01); *B05D 7/14* (2013.01); *C23C 22/362* (2013.01); *C23C 22/365* (2013.01); *C23C 22/73* (2013.01); *C23C 22/83* (2013.01)

(58) Field of Classification Search

CPC ..... B05D 3/107; B05D 7/14; C23C 22/362; C23C 22/365; C23C 22/73; C23C 22/83

USPC ..... 106/14.12, 247; 148/243

See application file for complete search history.

(56) References Cited

U.S. PATENT DOCUMENTS

| | | | | | |
|---|---|---|---|---|---|
| 4,849,031 | A * | 7/1989 | Hauffe et al. | ..... | 148/260 |
| 5,082,511 | A * | 1/1992 | Farina et al. | ..... | 148/257 |
| 5,143,562 | A * | 9/1992 | Boulos | ..... | 148/247 |
| 5,308,413 | A * | 5/1994 | Sobata et al. | ..... | 148/255 |
| 5,328,526 | A * | 7/1994 | Jo et al. | ..... | 148/260 |
| 5,399,208 | A * | 3/1995 | Sobata et al. | ..... | 148/241 |
| 5,401,381 | A * | 3/1995 | Seidel et al. | ..... | 205/177 |
| 5,503,733 | A * | 4/1996 | Speckmann et al. | ..... | 205/318 |
| 6,090,224 | A * | 7/2000 | Wichelhaus et al. | ..... | 148/256 |
| 6,551,417 | B1 * | 4/2003 | Rodzewich et al. | ..... | 148/250 |
| 6,620,263 | B1 * | 9/2003 | Sienkowski | ..... | 148/262 |
| 6,645,316 | B1 * | 11/2003 | Brouwer et al. | ..... | 148/253 |
| 6,720,032 | B1 * | 4/2004 | Kuhm et al. | ..... | 427/327 |
| 6,733,896 | B2 * | 5/2004 | Dolan et al. | ..... | 428/472 |
| 8,309,177 | B2 * | 11/2012 | Cape | ..... | 427/327 |
| 8,430,972 | B2 * | 4/2013 | Inbe et al. | ..... | 148/247 |
| 8,801,871 | B2 * | 8/2014 | Brouwer et al. | ..... | 148/253 |
| 2004/0129346 | A1 * | 7/2004 | Kolberg et al. | ..... | 148/247 |
| 2005/0205166 | A1 * | 9/2005 | Specht et al. | ..... | 148/262 |
| 2006/0113005 | A1 * | 6/2006 | Ando et al. | ..... | 148/254 |
| 2006/0243600 | A1 * | 11/2006 | Matsuda | ..... | 205/318 |
| 2006/0278307 | A1 * | 12/2006 | Nitschke et al. | ..... | 148/260 |
| 2009/0255608 | A1 * | 10/2009 | Brouwer et al. | ..... | 148/241 |
| 2011/0180186 | A1 * | 7/2011 | Nitschke et al. | ..... | 148/260 |
| 2011/0305840 | A1 * | 12/2011 | Ishii | ..... | 427/327 |

FOREIGN PATENT DOCUMENTS

| | | | | | |
|---|---|---|---|---|---|
| DE | 19735314 | A1 | 3/1998 | | |
| DE | 10155976 | A1 * | 5/2003 | ..... | C23C 22/77 |
| DE | 102005007752 | A1 * | 8/2006 | ..... | C23C 22/14 |
| EP | 0381190 | A1 | 8/1990 | | |
| EP | 0434358 | A2 | 6/1991 | | |
| EP | 0454361 | A2 | 10/1991 | | |
| EP | 0659906 | A1 | 6/1995 | | |
| EP | 1550740 | A1 | 7/2005 | | |
| EP | 1027170 | B1 | 11/2008 | | |
| WO | 9207974 | A1 | 5/1992 | | |
| WO | 9912661 | A1 | 3/1999 | | |
| WO | 0192597 | A2 | 12/2001 | | |
| WO | 02066702 | A1 | 8/2002 | | |
| WO | WO 2004/101850 | A1 * | 11/2004 | ..... | C23C 22/36 |
| WO | 2008055726 | A1 | 5/2008 | | |

OTHER PUBLICATIONS

International Search Report for PCT/EP2011/060590, dated Oct. 25, 2011. All references in the International Search Report are listed herein.

* cited by examiner

*Primary Examiner* — Anthony J Green
(74) *Attorney, Agent, or Firm* — Mary K. Cameron

(57) ABSTRACT

A multistage method for treatment of composite metal structures containing metallic surfaces of aluminum, zinc and optionally iron, is provide wherein in a first step, selective zinc phosphating of zinc and ferrous surfaces proceeds using a phosphating solution containing a quantity of water-soluble inorganic silicon compounds sufficient to suppress white spot formation on zinc, but less than the quantity where zinc phosphating loses selectivity. In a following second step, aluminum surfaces are passivated with an acidic treatment solution. Also provided is a zinc phosphating solution suitable for said method containing at least 0.025 g/l, but less than 1 g/l of silicon as water-soluble inorganic compounds calculated as $SiF_6$, wherein the product (Si/mM)·(F/mM) of the concentration of silicon [Si in mM] in the form of water-soluble inorganic compounds and the concentration of free fluoride [F in mM] divided by the free acid point number is no greater than 5.

19 Claims, No Drawings

METHOD FOR SELECTIVELY PHOSPHATING A COMPOSITE METAL CONSTRUCTION

The present invention relates to the corrosion-protective treatment of composite metal structures containing metallic surfaces made of aluminum, zinc, and optionally iron, in a multistage method. The method according to the present invention makes possible selective zinc phosphating of the zinc and iron surfaces of the composite metal structure, without deposition of significant quantities of zinc phosphate on the aluminum surfaces. The aluminum surface is thereby available, in a subsequent method step, for passivation with conventional acid treatment solutions that produce a thin, homogeneous, conversion layer that protects against. In the method according to the present invention, on the one hand the formation of phosphate crystal clusters on the aluminum surfaces, and on the other hand white spot formation on zinc surfaces, is suppressed. The present invention accordingly also relates to a zinc phosphating solution containing water-soluble inorganic compounds of silicon in a quantity that is sufficient to suppress white spot formation but does not exceed values at which zinc phosphating loses its selectivity for the zinc and iron surfaces of the composite metal structure.

In the automotive production sector, which is particularly relevant for the present invention, different metallic materials are to an increasing extent being used and fitted together into composite structures. A very wide variety of steels continue to be used in auto body design because of their specific material properties; but lightweight metals such as aluminum, which are particularly significant in terms of a considerable weight reduction for the body as a whole, are also increasingly utilized. In order to take account of this development, it is necessary to develop new concepts for body protection, or to further develop existing methods and compositions for the corrosion-protective treatment of the basic body. A demand therefore exists for improved pretreatment methods for complex components such as, for example, automobile bodies, which contain parts made not only of aluminum but also of steel and optionally of galvanized steel. The intended result of the pretreatment as a whole is to produce, on all the metal surfaces that occur, a conversion layer or passivating layer that is suitable as a corrosion-protective paint substrate, in particular prior to cathodic electrodip coating.

German Application DE 19735314 proposes a two-stage method in which firstly a selective phosphating of the steel surfaces and galvanized-steel surfaces of a body also comprising aluminum surfaces occurs, and then a treatment of the body with a passivating solution for corrosion-protective treatment of the aluminum parts of the body. According to the teaching disclosed therein, selective phosphating is achieved by the fact that the pickling effect of the phosphating solution is decreased. For this, DE 19735314 teaches phosphating solutions with a free fluoride content of less than 100 ppm, the source of the free fluoride being constituted exclusively by water-soluble complex fluorides, in particular hexafluorosilicates, at a concentration from 1 to 6 g/l.

The existing art discloses other two-stage pretreatment methods that likewise follow the concept of depositing a crystalline phosphate layer on the steel surfaces, and optionally the galvanized and alloy-galvanized steel surfaces, in the first step, and passivating the aluminum surfaces in a further subsequent step. These methods are disclosed in the documents WO 99/12661 and WO 02/066702. In principle, the methods disclosed therein are carried out in such a way that in a first step a selective phosphating of the steel surfaces or galvanized steel surfaces occurs, said phosphating being retained even in the context of post-passivation in a second method step, while no phosphate crystals are formed on the aluminum surfaces. Selective phosphating of the steel surfaces and galvanized steel surfaces is achieved by temperature-dependent limiting of the proportion of free fluoride ions in the phosphating solutions, the free acid concentrations of which are set in a range from 0 to 2.5 points.

International Application WO 2008/055726 discloses an at least one-stage method for selective phosphating of steel surfaces and galvanized steel surfaces of a composite structure that encompasses aluminum parts. This Application teaches phosphating solutions containing water-soluble inorganic compounds of the elements zirconium and titanium, the presence of which successfully suppresses phosphating of the aluminum surfaces.

Proceeding from this existing art, the task is to further develop the selective phosphating of steel and galvanized steel, in the context of corrosion-protective treatment of metallic components assembled in a mixed design and comprising aluminum surfaces, in such a way that an improvement in process economy during phosphating is achieved by targeted monitoring of the bath parameters that control selectivity. This includes in particular, with regard to the quality of the corrosion-protective treatment of composite metal structures, avoiding the occurrence of phosphate crystal clusters on the aluminum surfaces, and avoiding the occurrence of pinholes on the galvanized steel surfaces.

One skilled in the art understands "phosphate crystal clusters" to mean the isolated and locally delimited deposition of phosphate crystals on metal surfaces (in this case, aluminum surfaces). "Crystal clusters" of this kind become enclosed by a subsequent paint primer, and represent inhomogeneities in the coating that not only can interfere with the uniform visual impression of the painted surfaces, but also can cause single-point paint damage.

"White spot formation" is understood by one skilled in the art of phosphating as the phenomenon of local deposition of amorphous white zinc phosphate in an otherwise crystalline phosphate layer on the treated zinc surfaces resp. on the treated galvanized or alloy-galvanized steel surfaces. White spot formation is brought about by a locally elevated rate of pickling of the substrate. Point defects of this kind in the phosphating can be the starting point for corrosive delamination of subsequently applied organic paint systems, so that the occurrence of pinholes must be largely avoided in practice.

This above-described object is achieved, according to the present invention, by a method for the chemical pretreatment of a composite metal structure which contains at least one part made of aluminum and at least one part made of zinc and optionally a further part made of iron, this method comprising (I) in a first step, treatment of the composite metal structure with a zinc phosphating solution, which, on the parts made from zinc and iron, brings about the formation of a surface-covering crystalline zinc phosphate layer with a coating weight in the range from 0.5 to 5 $g/m^2$, but does not produce a zinc phosphate layer with a coating weight of at least 0.5 $g/m^2$ on the aluminum parts, and then, with or without intermediate rinsing with water, (II) in a second step, application of an acid treatment solution which has a pH value in the range from 3.5 to 5.5, onto the composite metal structure, which acid treatment solution, on the parts made of zinc and iron, dissolves away no more than 50% of the crystalline zinc phosphate, but forms a passivating conversion layer on the aluminum parts which does not represent a surface-covering crystalline phosphate layer with a layer weight of at least 0.5 $g/m^2$, the zinc phosphating solution in step (I) having a temperature in the range from 20 to 65° C. and containing a quantity of free fluorides (measured in g/l) which amounts to at least 0.005 g/l but is no greater than the quotient of the number 8 and the solution temperature in ° C. (8/T), the zinc phosphating solution containing at least 0.025 g/l, but less than 1 g/l of silicon in the form of water-soluble inorganic compounds calculated as $SiF_6$ and the product (Si/mM)·(F/mM) of the concentration of silicon [Si in mM] in the form of water-soluble inorganic compounds and the concentration of free fluoride [F in mM] divided by the free acid point number being no greater than 5, the free acid point number in the zinc phosphating solution amounting to at least 0.4 points but not exceeding a value of 3.0 points.

According to the present invention, the material "aluminum" is also understood as alloys thereof. At the same time, the material "zinc" also encompasses, according to the present invention, galvanized steel and alloy-galvanized steel, while the recitation of "iron" also includes iron alloys, in particular steel. Alloys of the aforesaid materials have an impurity atom proportion of less than 50 atomic percent.

The requirement that a zinc phosphate layer must not form on the aluminum parts in treatment step (I) is to be understood to mean that a continuous and sealed crystalline layer is not to occur thereon. This condition is met at least when the mass per unit area of zinc phosphate deposited onto the aluminum parts amounts to less than 0.5 $g/m^2$. "Aluminum parts" are understood in the context of the present invention as panels and components made of aluminum and/or of aluminum alloys.

The formation of a continuous and crystalline zinc phosphate layer on the steel surfaces and/or galvanized and/or alloy-galvanized steel surfaces is, on the other hand, absolutely necessary and characteristic of the method according to the present invention. For this, zinc phosphate layers with a coating weight per unit area of by preference at least 1.0 $g/m^2$, particularly preferably at least 2.0 $g/m^2$, but by preference no more than 4.0 $g/m^2$, are deposited onto those surfaces of the composite metal structure in step (I) of the method according to the present invention.

The zinc phosphate surface coverage is determined, for all surfaces of the composite metal structure, with the aid of gravimetric differential weighing on test panels of the individual metallic materials of the respective composite metal structure. Steel panels are brought into contact, immediately after a step (I), for 15 minutes with an aqueous 5-wt % $Cr0_3$ solution at a temperature of 70° C., thereby removing the zinc phosphate surface coating from them. Analogously, for determination of the zinc phosphate surface coverage on galvanized or alloy-galvanized steel panels, a corresponding test panel is brought into contact, immediately after a step (I), for 5 minutes with an aqueous 5-wt % $CrO_3$ solution at a temperature of 25° C., thereby removing the zinc phosphate layer from them. Aluminum panels, on the other hand, are brought into contact, immediately after a step (I), for 15 minutes with an aqueous 65-wt % $HNO_3$ solution at a temperature of 25° C., which correspondingly removes zinc phosphate components. The difference between the weight of the dry metal panels after this respective treatment and the weight of the same dry untreated metal panel immediately before step (I) corresponds to the zinc phosphate surface coverage in accordance with this invention.

The requirement according to the present invention that no more than 50% of the crystalline zinc phosphate layer on the steel surfaces and galvanized and/or alloy-galvanized steel surfaces be dissolved in step (II) can likewise be implemented on the basis of test panels of the individual metallic materials of the respective composite metal structure. For this, the test panels made of steel or galvanized or alloy-galvanized steel, phosphated in accordance with step (I) of the method according to the present invention and after a rinsing step with deionized water, are blown dry with compressed air and then weighed. The same test panel is then, in accordance with step (II) of the method according to the present invention, brought into contact with the acid treatment solution, then rinsed with deionized water, blown dry with compressed air, and then weighed again. The zinc phosphating of the same test panel is then completely removed with 5-wt % $Cr0_3$ solution as described above, and the dried test panel is weighed one more time. The percentage loss of phosphate layer in step (II) of the method according to the present invention is then determined from the weight differences of the test panel.

The free acid (in points) of the zinc phosphating solution is determined in step (I) of the method according to the present invention by diluting a 10-ml sample volume of the phosphating solution to 50 ml and titrating with 0.1 N sodium hydroxide to a pH value of 3.6. The quantity (in ml) of sodium hydroxide consumed indicates the free acid point number.

The concentration of free fluoride in the zinc phosphating solution is determined, in the method according to the present invention, by means of a potentiometric method. A sample volume of the zinc phosphating solution is removed, and the activity of the free fluoride ions is determined using any commercial fluoride-selective potentiometric electrode, after calibration of the electrode using fluoride-containing buffer solutions without pH buffering. both calibration of the electrode and measurement of the free fluoride are performed at a temperature of 20° C.

If the free fluoride concentration (in g/l) according to the present invention, defined by the quotient 8/T, is exceeded, this causes deposition of a complete-coverage crystalline zinc phosphate layer onto the aluminum surfaces. Formation of such a layer is, however, not desired because of the substrate-specific coating properties of zinc phosphating, and is therefore not in accordance with the invention. A certain minimum quantity of free fluoride is, however, necessary in order to ensure sufficient deposition kinetics for the zinc phosphate layer onto the iron and zinc surfaces of the composite metal structure, since simultaneous treatment of the aluminum surfaces of the composite metal structure in particular causes aluminum cations to pass into the zinc phosphating solution and in turn, in uncomplexed form, to inhibit zinc phosphating.

The addition according to the present invention of water-soluble inorganic compounds containing silicon brings about suppression of white spot formation on the zinc surfaces; for this, at least 0.025 g/l of these compounds, calculated as $SiF_6$, must be contained in the phosphating bath, but only less than 1 g/l, by preference less than 0.9 g/l, must be contained. The upper limit is governed on the one hand by the cost-effectiveness of the method and on the other hand by the fact that process monitoring is made considerably more difficult by such high concentrations of the water-soluble inorganic compounds containing silicon, since the formation of phosphate crystal clusters on the aluminum surfaces can be only insufficiently prevented by an increase in the free acid content. The crystal clusters can in turn represent local surface defects that are starting points for corrosive delamination of the subsequently applied dip-coating paint. In addition, crystal clusters of this kind cause single-point elevations once the paint structure is complete; these always need to be sanded down in order to produce a visually uniform paint coating on the composite metal structure, e.g. an automobile body, as desired by the customer.

It has been found, surprisingly, that in terms of effective suppression of the formation of a crystalline zinc phosphate layer and of zinc phosphate crystal clusters on the aluminum surfaces, the ratio of the ionic product of the concentration of silicon in the form of water-soluble inorganic compounds and of free fluoride, and the free acid point number in the phosphating solution is decisive as a critical parameter for the success of the method according to the present invention. If this quotient is exceeded, formation of at least individual zinc phosphate crystal clusters on the aluminum surfaces already occurs. As this critical parameter is further exceeded, the aluminum surfaces in the method according to the present invention are covered with a complete-coverage crystalline zinc phosphate layer. For a successful corrosion-protective pretreatment, both scenarios must absolutely be avoided. It is therefore preferred to use, in step (I) of the method according to the present invention, zinc phosphating solutions whose product (Si/mM)·(F/mM) of the concentration of silicon [Si in mM] in the form of water-soluble inorganic compounds and the concentration of free fluoride [F in mM], divided by the free acid point number, does not exceed a value of 4.5, particularly preferably a value of 4.0. In any case, however, the proportion according to the present invention of silicon in the form of water-soluble inorganic compounds is sufficient to prevent white spot formation on the zinc parts treated according to the present invention. Water-soluble inorganic compounds containing silicon that are preferred in the method according to the present invention are fluorosilicates, particularly preferably $H_2SiF_6$, $(NH_4)SiF_6$, $Li_2SiF_6$, $Na_2SiF_6$, and/or $K_2SiF_6$. The water-soluble fluorosilicates are moreover suitable as a source of free fluoride, and therefore serve to complex trivalent aluminum cations carried into the bath solution, so that phosphating on the steel surfaces, as well as galvanized and/or alloy-galvanized steel surfaces, is still ensured. When fluorosilicates are used in phosphating solutions in step (I) of the method according to the present invention, care must of course always be taken that the ionic product of silicon in the form of water-soluble inorganic compounds and free fluoride in relation to the free acid point number, according to claim 1 of the present invention, is not exceeded.

Zinc phosphating solutions with a free acid content of more than 0.6 points are preferred in methods according to the present invention in step (I), particularly preferably of at least 1.0 point, but by preference no more than 2.5 points, particularly preferably no more than 2.0 points. Observance of the preferred ranges for free acid ensures on the one hand sufficient deposition kinetics for the phosphate layer on the selected metal surfaces, and on the other hand prevents unnecessary pickling removal of metal ions, which in turn requires intensive monitoring or reprocessing of the phosphating bath in order to avoid precipitation of sludges, or to dispose of them during continuous operation of the method according to the present invention.

In addition, the total acid content in the phosphating solution in step (I) of the method according to the present invention should amount to at least 10 points, preferably at least 15 points, but no more than 50 points, preferably no more than 25 points.

In a further preferred embodiment of the method according to the present invention, the zinc phosphating solution in step (I) contains in total no more than 5 ppm, particularly preferably in total no more than 1 ppm of water-soluble compounds of zirconium and/or titanium relative to the elements zirconium and/or titanium.

It is known from WO 2008/055726 that the presence of water-soluble compounds of these elements in a phosphating step is likewise capable of effectively suppressing the formation of crystalline phosphate layers on aluminum surfaces. It has become apparent, however, that in the presence of water-soluble compounds of zirconium and/or titanium, an inhomogeneous amorphous zirconium- and/or titanium-based conversion coating is more often produced on the aluminum parts, in particular when the phosphating solution is applied by spraying; this leads to the occurrence of "mapping" in the context of a subsequent organic painting operation. "Mapping" is understood by one skilled in the art of dipcoating metallic components as a speckled visual impression of the paint coating, due to an inhomogeneous paint layer thickness after stoving of the dipcoating paint. The addition in particular of water-soluble compounds of zirconium and/or titanium in phosphating solutions is consequently entirely avoided in the method according to the present invention. It is additionally necessary, when applying phosphating solutions that contain water-soluble compounds of zirconium and/or titanium, to correspondingly increase the free fluoride proportion in the phosphating bath in order to avoid inhibiting the formation of a phosphate layer on iron surfaces resp. steel surfaces of the metallic component. Such an increase in the free fluoride proportion promotes the formation of phosphate crystal clusters on the aluminum parts, however, and at the same time increases the pickling rate, so that the elevated sludge formation has a disadvantageous effect on the cost-effectiveness of the method. The presence of the water-soluble compounds of zirconium and/or titanium in a method according to the present invention therefore either produces comparatively lower zinc phosphate layer weights on steel surfaces, or produces aluminum surfaces on which local defects in the form of phosphate crystal clusters interfere with a homogeneous paint structure and potentially promote corrosive paint delamination. For an optimum phosphating outcome on metallic components that comprise not only aluminum surfaces but also surfaces made of steel and of galvanized and/or alloy-galvanized steel, zinc phosphating solutions that contain no more than 5 ppm, particularly preferably in total no more than 1 ppm of water-soluble compounds of zirconium and/or titanium relative to the elements zirconium and/or titanium, and particularly preferably no water-soluble compounds of zirconium and/or titanium, are therefore preferred in step (I) of the method according to the present invention.

The zinc phosphating solution contains, in step (I) of the method according to the present invention, by preference at least 0.3 g/l, particularly preferably at least 0.8 g/l, but preferably no more than 3 g/l, particularly preferably no more than 2 g/l of zinc ions. The proportion of phosphate ions in the phosphating solution in this context by preference amounts to at least 5 g/l, but is preferably no greater than 50 g/l, particularly preferably no greater than 25 g/l.

The zinc phosphating solution of the method according to the present invention can additionally contain, besides the zinc ions and phosphate ions recited above, at least one of the following accelerators:

| | |
|---|---|
| 0.3 to 4 g/l | chlorate ions, |
| 0.01 to 0.2 g/l | nitrite ions, |
| 0.05 to 4 g/l | nitroguanidine, |
| 0.05 to 4 g/l | N-methylmorpholine-N-oxide, |
| 0.2 to 2 g/l | m-nitrobenzenesulfonate ions, |
| 0.05 to 2 g/l | m-nitrobenzoate ions, |
| 0.05 to 2 g/l | p-nitrophenol, |
| 1 to 150 mg/l | hydrogen peroxide in free or bound form, |
| 0.1 to 10 g/l | hydroxylamine in free or bound form, |
| 0.1 to 10 g/l | reducing sugars. |

Such accelerators are usual in the existing art as components of phosphating baths and perform the function of "hydrogen catchers," by directly oxidizing the hydrogen resulting from acid attack on the metallic surface and thereby being themselves reduced. The formation of a homogeneous crystalline zinc phosphate layer on the steel surfaces and on the galvanized and/or alloy-galvanized steel surfaces is substantially facilitated by the accelerators, which decrease the occurrence of gaseous hydrogen on the metallic surface.

The corrosion protection and paint adhesion of crystalline zinc phosphate layers produced with an aqueous composition according to the present invention are improved according to the present invention if one or more of the following cations are additionally contained:

| | |
|---|---|
| 0.001 to 4 g/l | manganese(II), |
| 0.001 to 4 g/l | nickel(II), |
| 0.001 to 4 g/l | cobalt (II), |
| 0.002 to 0.2 g/l | copper(II), |
| 0.2 to 2.5 g/l | magnesium(II), |
| 0.2 to 2.5 g/l | calcium(II), |
| 0.01 to 0.5 g/l | iron(II), |
| 0.2 to 1.5 g/l | lithium(I), |
| 0.02 to 0.8 g/l | tungsten(VI). |

Aqueous compositions for conversion treatment that contain, besides zinc ions, both manganese and nickel ions are known to one skilled in the art of phosphating as "trication" phosphating solutions, and are also well-suited in the context of the present invention. A proportion of up to 5 g/l, by preference up to 3 g/l nitrate, as is usual in the context of phosphating, also facilitates the formation of a homogeneous and continuous crystalline phosphate layer on the steel surfaces and galvanized and alloy-galvanized steel surfaces.

In addition to the aforementioned cations that become incorporated into the phosphate layer resp. at least have a positive effect on the crystal growth of the phosphate layer, the phosphating solutions in step (I) of the method according to the present invention as a rule also contain sodium ions, potassium ions, and/or ammonium ions which, by way of the addition of the corresponding alkalis, function to adjust the free acid content in the phosphating solution.

In step (II) of the method, bringing the composite metal structure into contact with the acid treatment solution results, according to the present invention, in the formation of a conversion layer on the aluminum surfaces, the zinc phosphate layer on the steel surfaces, galvanized and/or alloy-galvanized steel surfaces being no more than 50%, by preference no more than 20%, preferably no more than 10% dissolved while being brought into contact with the treatment solution. In the context of the present invention, a "conversion layer on aluminum" is considered to be passivating inorganic or mixed inorganic/organic thin layers that are not continuous crystalline phosphate layers and therefore have a mass per unit area of less than 0.5 g/m$^2$ phosphate layer, determined by differential weighing after the aluminum surfaces are brought into contact with 65-wt % nitric acid for 15 minutes at 25° C.

While the pH value of the acid treatment solution in the range from 3.5 to 5.5 already substantially guarantees that no more than 50% of the zinc phosphate layer on the steel surfaces, galvanized and/or alloy-galvanized steel surfaces is dissolved, the corresponding conversion layers on the aluminum surfaces of the composite metal structure are typically produced using chromium-free acid treatment solutions that contain water-soluble compounds of the elements Zr, Ti, Hf, Si, V, and Ce, by preference in a quantity of at least 10 ppm in total relative to the respective elements. A method according to the present invention in which the acid treatment solution in step (II) contains in total 10 to 1500 ppm of fluoro complexes of zirconium and/or titanium relative to the elements zirconium and/or titanium, and optionally up to 100 ppm, optionally by preference at least 1 ppm of copper(II) ions, is particularly preferred.

The method according to the present invention, for corrosion-protective treatment of composite metal structures assembled from metallic materials and at least in part also comprising aluminum surfaces, occurs after cleaning and activation of the metallic surfaces, firstly by bringing the surfaces into contact with the zinc phosphating solution of step (I), e.g. using a spray or dip method, at temperatures in the range from 20-65° C. and for a time span coordinated with the manner of application. Experience indicates that white spot formation on the galvanized and/or alloy-galvanized steel surfaces is particularly pronounced in conventional dip-type phosphating methods, so that the phosphating operation in step (I) of the method according to the present invention is also particularly suitable for those phosphating facilities that operate on the dipcoating principle, since white spot formation is suppressed in the method according to the present invention.

Application of the phosphating solution in step (I) is usually immediately followed by a rinsing operation with tap water or demineralized water; after processing of the rinse water enriched with components of the treatment solution, a selective recycling of components of the phosphating solution into the phosphating bath in accordance with step (I) of the method according to the present invention can be performed. With or without this rinsing step, the composite metal structure treated in accordance with step (I) is brought into contact in step (II) with the acid treatment solution, by immersion or by spraying the solution. In a further subsequent step the composite metal structure can be provided with a primer coat, by preference with an organic dipcoating paint, by preference without prior drying of the component treated according to the present invention.

The composite metal structure protected from corrosion in accordance with the method according to the present invention is utilized in automotive production in body construction, in ship-building, in construction trades, and for the manufacture of white goods.

In a further aspect, the present invention relates to a zinc phosphating solution (A) for selective phosphating of steel surfaces, galvanized and/or alloy-galvanized steel surfaces in a metallic composite structure encompassing a portion made of aluminum, the zinc phosphating solution (A) having a free acid content of at least 0.4 points, but no more than 3 points, and a pH value in the range from 2.2 to 3.6, and containing (a) 5-50 g/l phosphate ions, (b) 0.3-3 g/l zinc(II) ions, (c) at least 10 ppm, but no more than 100 ppm of free fluoride ions, and (d) at least 0.025 g/l, but less than 1.0 g/l of silicon in the form of water-soluble inorganic compounds calculated as $SiF_6$, the product (Si/mM)·(F/mM) of the concentration of silicon [Si in mM] in the form of water-soluble inorganic compounds and the concentration of free fluoride [F in mM] divided by the free acid point number being no greater than 5, by preference no greater than 4.5, particularly preferably no greater than 4.0.

In a preferred variant, the zinc phosphating solution (A) according to the present invention contains in total no more than 5 ppm, particularly preferably in total no more than 1 ppm of water-soluble compounds of zirconium and/or titanium relative to the elements zirconium and/or titanium, and in particular no water-soluble compounds of zirconium and/or titanium.

The invention claimed is:

1. A zinc phosphating solution comprising:

(a) 5-50 g/l of phosphate ions, (b) 0.3-3 g/l of zinc(II) ions, (c) a concentration of free fluoride, in g/l which is at least 0.005 g/l, and no greater than 8/T g/l wherein T is the temperature at which the solution is used for coating, (d) at least 0.025 g/l, but less than 1.0 g/l of silicon in the form of water-soluble inorganic compounds calculated as $SiF_6$, said zinc phosphating solution having a free acid point number of at least 0.4 points, but of no more than 3 points and a pH value in the range from 2.2 to 3.6; wherein a product "(Si/mM)·(F/mM)" of concentration of silicon [Si in mM] in the form of water-soluble inorganic compounds and concentration of free fluoride [F in mM] divided by the free acid point number is no greater than 5, wherein the zinc phosphating solution is effective for coating zinc or iron surfaces to form a continuous coating, but forms no continuous coating on aluminum surfaces at under the same coating conditions used for coating zinc or iron surfaces to form a continuous coating.

2. The zinc phosphating solution according to claim 1, comprising in total no more than 5 ppm of water-soluble compounds of zirconium, measured as zirconium, and/or titanium, measured as titanium.

3. The zinc phosphating solution according to claim 1, comprising a free acid content of at least 0.6 points, but of no more than 2.5 points.

4. The zinc phosphating solution according to claim 1, comprising a total acid content of at least 10 points, but no more than 50 points.

5. The zinc phosphating solution according to claim 1, comprising in total no more than 1 ppm of water-soluble compounds of zirconium and/or titanium measured as zirconium and/or titanium, and having a free acid content of at least 1.0 point, but no more than 2.0 points, and a total acid content of at least 15 points, but no more than 25 points.

6. The zinc phosphating solution of claim 1, wherein from 0.025 g/l to less than 0.9 g/l of silicon is contained in the solution.

7. The zinc phosphating solution of claim 1, wherein the (Si/mM)·(F/mM) of concentration of silicon [Si in mM] in the form of water-soluble inorganic compounds and concentration of free fluoride [F in mM] divided by the free acid point number is no greater than 4.5.

8. The zinc phosphating solution of claim 1, wherein the (Si/mM)·(F/mM) of concentration of silicon [Si in mM] in the form of water-soluble inorganic compounds and concentration of free fluoride [F in mM] divided by the free acid point number is no greater than 4.0.

9. The zinc phosphating solution of claim 1, wherein the free acid point number is from 1.0 to 2.0.

10. The zinc phosphating solution of claim 1, which provides a continuous coating on iron and/or zinc surfaces in an areal weight of >0.5 g/m$^2$, while under the same conditions forms no continuous coating on aluminum surfaces under the same conditions, any discontinuous deposition on aluminum surfaces having an areal weight of <0.5 g/m$^2$.

11. The zinc phosphating solution of claim 10, which is effective to deposit a zinc phosphate layer having a areal weight of 1.0 g/m$^2$ to 4.0 g/m$^2$ on zinc and iron surfaces but which, under the same conditions, deposits no more than a discontinuous layer with an areal weight of <0.5 g/m$^2$ on aluminum surfaces.

12. The zinc phosphating solution of claim 10, which is effective to deposit a zinc phosphate layer having a areal weight of 1.0 g/m$^2$ to 2.0 g/m$^2$ on zinc and iron surfaces but which, under the same conditions, deposits no more than a discontinuous layer with an areal weight of <0.5 g/m$^2$ on aluminum surfaces.

13. The zinc phosphating solution of claim 1, which contains ≤5 ppm total of water soluble compounds of zirconium and titanium, calculated on the basis of the elements zirconium and titanium.

14. The zinc phosphating solution of claim 1, which contains ≤1 ppm total of water soluble compounds of zirconium and titanium, calculated on the basis of the elements zirconium and titanium.

15. A zinc phosphating solution consisting essentially of:

(a) 5-50 g/l of phosphate ions, (b) 0.3-3 g/l of zinc(II) ions, (c) at least 10 ppm, but no more than 100 ppm of free fluoride ions, (d) at least 0.025 g/l, but less than 1.0 g/l of silicon in the form of water-soluble inorganic compounds calculated as $SiF_6$, (e) optionally, one or more accelerants, and (f) optionally, one or more metal cations other than zinc cations, said zinc phosphating solution having a free acid point number of at least 0.4 points, but of no more than 3 points and a pH value in the range from 2.2 to 3.6; wherein a product "(Si/mM)·(F/mM)" of concentration of silicon [Si in mM] in the form of water-soluble inorganic compounds and concentration of free fluoride [F in mM] divided by the free acid point number is no greater than 5, wherein the zinc phosphating solution is effective for forming a continuous coating on zinc and/or iron surfaces but forms no continuous coating on aluminum surfaces under the same coating conditions.

16. A zinc phosphating solution consisting essentially of:

(a) 5-50 g/l of phosphate ions, (b) 0.3-3 g/l of zinc(II) ions, (c) at least 10 ppm, but no more than 100 ppm of free fluoride ions, (d) at least 0.025 g/l, but less than 1.0 g/l of silicon in the form of water-soluble inorganic compounds calculated as $SiF_6$, (e) optionally, one or more accelerants selected from the group consisting of chlorate ions, nitrite ions, nitroguanidine, N-methylmorpholine-N-oxide, m-nitrobenzene sulfonate ions, m-nitrobenzoate ions, p-nitrophenol, hydrogen peroxide, hydroxylamine, and reducing sugar, and (d) optionally, one or more metal cations selected from the group consisting of nickel (II), cobalt (II), magnesium, calcium, iron (II), lithium, and tungsten, said zinc phosphating solution having a free acid point number of at least 0.4 points, but of no more than 3 points and a pH value in the range from 2.2 to 3.6; wherein a product "(Si/mM)·(F/mM)" of concentration of silicon [Si in mM] in the form of water-soluble inorganic compounds and concentration of free fluoride [F in mM] divided by the free acid point number is no greater than 5, wherein the zinc phosphating solution is effective for forming a continuous coating on zinc and/or iron surfaces but forms no continuous coating on aluminum surfaces under the same coating conditions.

17. A zinc phosphating solution for use in the simultaneous coating of a composite article comprising at least one surface of iron or zinc, and at least one surface of aluminum, comprising:

(a) 5-50 g/l of phosphate ions, (b) 0.3-3 g/l of zinc(II) ions, (c) a concentration of free fluoride, in g/l which is at least 0.005 g/l, (d) at least 0.025 g/l, but less than 1.0 g/l of silicon in the form of water-soluble inorganic compounds calculated as $SiF_6$, said zinc phosphating solution having a free acid point number of at least 0.4 points, but of no more than 3 points and a pH value in the range from 2.2 to 3.6; wherein a product "(Si/mM)·(F/mM)" of concentration of silicon [Si in mM] in the form of water-soluble inorganic compounds and concentration of free fluoride [F in mM] divided by the free acid point number is no greater than 5, wherein the zinc phosphating solution does not deposit a complete-coverage zinc phosphate layer onto aluminum surfaces of said composite article, but does deposit a continuous coating of zinc phosphate onto surfaces of iron or zinc of said composite article.

18. The zinc phosphating solution of claim 17 which is suitable for use in coating composite articles at a temperature T in the range of 20° C. to 65° C., wherein the free fluoride concentration is from 0.005 g/l to 8/T g/l.

19. The zinc phosphating solution of claim 17, wherein the free fluoride concentration is from 0.005 g/l to 8/65 g/l.

* * * * *